US005768995A

United States Patent [19]

Miyaguchi et al.

[11] Patent Number: 5,768,995

[45] Date of Patent: Jun. 23, 1998

[54] METHOD FOR PRODUCING A WATERLESS LITHOGRAPHIC PRINTING PLATE

[75] Inventors: Akinori Miyaguchi; Shuzaburo Kobayashi, both of Tokyo, Japan

[73] Assignee: Corporation Association "Printechno", Tokyo, Japan

[21] Appl. No.: 791,805

[22] Filed: Jan. 30, 1997

[51] Int. Cl.[6] ..... G03G 13/28

[52] U.S. Cl. ..... 101/463.1; 430/49; 101/465

[58] Field of Search ..... 101/457, 460, 101/462, 463.1, 467, 465, 466; 430/49

[56] References Cited

U.S. PATENT DOCUMENTS

| | | | |
|---|---|---|---|
| 3,907,562 | 9/1975 | Crystal | 101/465 |
| 3,961,947 | 6/1976 | Wells | 101/463.1 |
| 5,455,134 | 10/1995 | Dankert | 430/49 |
| 5,685,701 | 11/1997 | Kato | 430/49 |

FOREIGN PATENT DOCUMENTS 89364 4/1991 Japan .

*Primary Examiner*—Stephen R. Funk

*Attorney, Agent, or Firm*—Wenderoth, Lind & Ponack, L.L.P.

[57] ABSTRACT

Ink-receptive printing parts formed on a waterless planographic printing plate are formed with toner, and ink-repellent non-printing parts of the same are formed of silicone rubber, so that the printing plate can be produced without using a light exposing device and a developing device. The printing plate using paper as a substrate can be produced at a low cost compared with that using an aluminum printing substrate. The production of the waterless planographic printing plate without use of organic solvent prevents working effectiveness in printing from being deteriorated.

2 Claims, 1 Drawing Sheet

METHOD FOR PRODUCING A WATERLESS LITHOGRAPHIC PRINTING PLATE

BACKGROUND OF THE INVENTION

1. Field of the Invention

This invention relates to a waterless planographic printing plate capable of performing clear and sharp printing of letters, images and so forth with excellent reproducibility without using damping water. This invention further relates to a method for producing a waterless planographic printing plate suitable for a so-called on-demand printing system capable of making the desired number of printed matter on demand.

2. Description of the Prior Art

Printing methods which have been so far used are generally classified broadly into four printing methods, i.e. relief printing, planographic printing, intaglio printing, and stencil printing. Of these printing methods, the planographic printing has been utilized for offset printing which makes use of damping water, and being in great demand.

As a waterless printing plate which is used in the planographic printing without using damping water, a so-called waterless plate formed of photosensitive polymeric material has been known. Further, there has been known a method for producing such a waterless printing plate, in which a substrate having a photosensitive resin layer and a silicone rubber layer is exposed to light while being selectively masked with a positive film, the parts which are not exposed to light on the silicone rubber layer are inflated with an organic solvent, and then, the inflated parts of the silicone rubber layer are shaven off (Japanese Patent Publication No. SHO 54-26923(B)). Another method has been known, in which a printing plate is obtained by partially exposing a substrate coated with a photosensitive layer to light by using a positive masking film, causing desired image parts which are not exposed to light to be left by developing, further forming a silicone rubber layer on the substrate, causing the parts of the silicone rubber layer on the image parts to be inflated, and then, shaving off the inflated parts of the silicone rubber layer (Japanese Patent Application Public Disclosure No. HEI 1-161242).

The on-demand printing system making use of a planographic printing plate with printing ink can perform multicolor printing for a short time one-fourth times as much as a common printing method so as to meet the needs for printing the desired number of printed matter, and therefore, it has taken on importance in the information intensive society of today. Formation of patterns or lines to be printed in the on-demand printing system is fulfilled by using a laser printer, a thermal transfer printer or a copying machine based on the data outputted from a computer, wordprocessor or the like. When colorant is used for printing, paper is most suitably used as a substrate for a printing plate.

However, since every conventional printing system requires a light-exposing device, a system for producing the printing plate disadvantageously turns out to be complicated. Furthermore, since the conventional printing system adopts an organic solvent, it entails problems such that outlines of details of the patterns and lines to be printed are apt to be obscure. Besides, the health of a printing operator is possibly undermined due to usage of the organic solvent, and working effectiveness in printing is deteriorated due to intense inflammability of the organic solvent. Moreover, the conventional printing system has suffered a disadvantage such as difficulty in being applied to the on-demand printing system as described above, because it takes a long time to produce a printing plate according to any conventional producing method.

The substrate of the printing plate used in the prior art printing system is formed of an aluminum plate as a matter of fact. Although paper is suitable as the substrate touched upon above, it has not yet been put to practical use.

OBJECT OF THE INVENTION

An object of the present invention is to provide a waterless planographic printing plate capable of performing clear and sharp printing of patterns, lines and so forth with excellent reproducibility without using damping water, and which can be suitably used for an on-demand printing system.

Another object of the present invention is to provide a method for easily producing a waterless planographic printing plate for an on-demand printing system without using a light exposing device and a developing device.

SUMMARY OF THE INVENTION

To attain the objects described above according to the present invention, there is provided a waterless planographic printing plate comprising a substrate, ink-receptive printing parts formed of toner, and ink-repellent non-printing parts formed of silicone rubber.

The substrate may be made of paper.

Further, according to the present invention, there is provided a method for producing a waterless planographic printing plate, which comprises outputting desired images to be printed onto a substrate with toner, heating the substrate, forming a silicone rubber layer on the substrate having the desired images formed with toner, and shaving parts of the silicone rubber layer, which are formed on the desired images.

After heating the substrate having the desired images formed with toner, water-soluble polymer may be applied to the surface of the substrate.

Other objects and features of the present invention will be hereinafter explained in detail with reference to the accompanying drawings.

DESCRIPTION OF THE PREFERRED EMBODIMENTS

Figure 1:
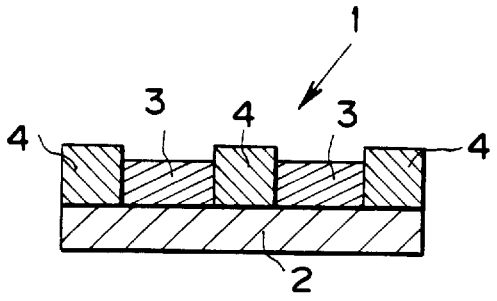
FIG. 1 is a cross section showing a waterless planographic printing plate according to the present invention.

Referring to FIG. 1, a waterless planographic printing plate 1 according to the present invention will be described. The waterless planographic printing plate 1 comprises a substrate 2, ink-receptive printing parts 3 formed on the substrate 2, and ink-repellent non-printing parts 4.

The substrate 2 is preferably formed of material which is stable in dimensions and has good adhesive properties relative to composite elements for forming the ink-receptive printing parts 3 and ink-repellent non-printing parts 4. That is, printing paper such as paper master and enamel paper which has been on the market is suitable as the substrate. The enamel paper is generally formed by coating paper with pigment such as clay, satin white, calcium carbonate, aluminum hydroxide, and titanium dioxide together with adhesives such as casein, latices, starch and PVA, and arbitrary additives such as anti-foaming agent, dye, and antiseptic agent, which are dispersed in a solvent such as water. Otherwise, cast coated paper may be used, whereas the substrate 2 is not limited only to paper, and may be formed of plastic or other possible material.

The printing part 3 is receptive to inks and formed of toner. The toner made of precolored fine particles, which is generally used as developer for an electrostatic latent image in electrophotography applied to a laser printer and a copying machine, includes thermoplastic resin, pigment, and electrorification controlling agent, and further contains a fluidizing agent as occasion calls.

The non-printing part 4 is an ink repellent made of silicone rubber. This non-printing part 4 is not specifically limited to silicone rubber, and may be made of compounds of organic radicals coupled with silicon atoms, alkyl radicals such as methyl radicals and ethyl radicals, or compounds obtained by substituting a part of the alkyl radicals with vinyl radicals, phenyl radicals or fluorinated alkyl radicals.

Figure 2:
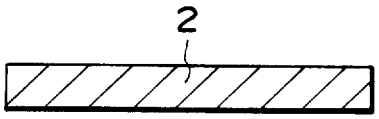
FIG. 2(*a*) through FIG. 2(*d*) are cross sections showing a process of producing the waterless planographic printing plate according to the invention.
Figure 2:
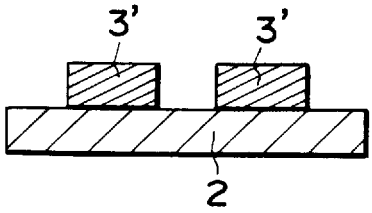
Figure 2:
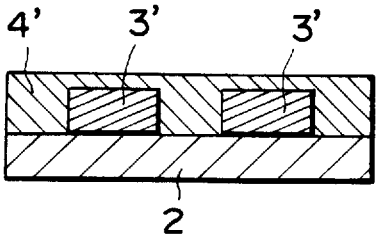
Figure 2:
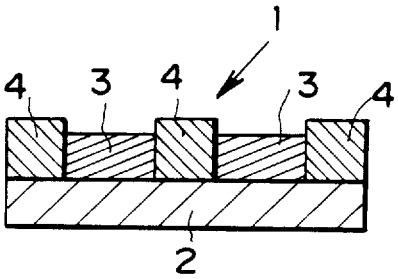

Next, the method for producing the waterless planographic printing plate 1 will be described with reference to FIG. 2(*a*) through FIG. 2(*d*).

As the first step, desired images 3' such as letters, patterns or lines are outputted onto the surface of the substrate 2 made of paper or the like with toner by using a laser printer, thermal transfer printer or copying machine.

The output toner image 3' formed on the substrate 2 with the toner covers lots of voids. If the substrate 2 with the voids is coated with silicone rubber in the second process, the silicone rubber is permitted to permeate and reach the substrate 2 through the voids, consequently to deteriorate releasability of the silicone rubber from the substrate.

To overcome such a disadvantage, the substrate 2 applied selectively with toner undergoes heat treatment so as to fuse and bond the toner particles to one another, thereby causing the voids among the printing parts constituting the output toner image 3' to vanish.

The heat treatment is carried out by passing the substrate between two heating rollers or heating the substrate in an oven at about 120° C. to 180° C. for about 10 to 60 seconds.

Prior to the second process, water-soluble polymer may be applied to the substrate 2 on which the toner image 3' is formed in the first process, as occasion demands, and then, dried.

This auxiliary treatment is done for the purpose of completely filling even fine voids left in the toner image 3' so as to provide for easy release of a silicone rubber layer 4' formed later on the substrate 2. As a water solution of the water-soluble polymer applied in this process, there may be used a water solution of polyvinyl alcohol, polyvinyl pyrrolidone, starch, dextrine, acacia gum and so on. The concentration of the water solution is preferably to 0.1 to 1.0 weight %.

As an assistant to be added to the water solution of the water-soluble polymer for the purpose of applying the water solution uniformly and smoothly, there may be added nonionic surface active agents such as polyhydroxy alcohol ester, polyoxyethylene type polyoxyalkylene ether and polyoxyethylene alkylphenol, sorbitan higher fatty acid ester, sucrose higher fatty acid ester, and mono-glyceride or diglyceride. The compounding rate of the nonionic surface active agent is preferably to 0.1 to 0.05 weight % relative to 100 weight % of water solution of the water-soluble polymer.

In the next process, the silicone rubber layer 4' serving as the non-printing parts 4 is formed on the substrate 2 on which the toner image 3' is formed in the preceding process. The silicone rubber layer 4' can be formed by applying a mixture of organopolysiloxane and a crosslinking agent to the surface of the substrate 2, on which the toner image 3' is formed, and curing the mixture.

The silicone rubber applied in this process may be of one-fluid type or two-fluid type liquid silicone rubber capable of curing at a normal temperature, and having a curing mechanism of additive type, condensation-curing type, or ultraviolet curing type.

As one example, the silicone rubber layer 4' may be formed on the substrate by applying a solventless composite consisting of a chief material of organopolysiloxane containing straight-chain vinyl radicals, a crosslinking agent of hydrogen organopolysiloxane, and a catalyst of platinum groups to the substrate with a roll coater or the like, and leaving the substrate at room temperature or heating the substrate in order to make the curing time short.

In general, it is preferable to apply the silicone rubber layer 4' to the substrate, so that the thickness of the layer 4' after hardening the silicone rubber turns out to be 3 to 100 μm so as to completely hide the toner image 3' with the layer 4'.

In the third process, the parts of the silicone rubber layer 4' over the toner image 3' are shaven to define the printing parts 3 and the non-printing parts 4.

A means necessary for partially shaving the silicone rubber layer 4' in this process is not specifically limited. As the shaving means, a piece of coarse cloth such as gauze and unwoven fabric, or a reverse roll coater may be used. There is no necessity for selectively shaving only the silicone rubber layer 4' over the printing parts of the toner image 3'. That is to say, even by shaving the whole surface of the silicone rubber layer 4', the printing parts 3' and the non-printing parts 4' can be formed, because the bonding strength between the toner and the silicone rubber is weak.

Silicone rubber swarf produced as the result of shaving can easily be removed by use of a gum roller or the like.

Although the present invention will be described in more detail referring to the following experimental examples according to the method of the invention in comparison with a prior art method, this invention is by no means limited merely to the following examples.

EXPERIMENTAL EXAMPLE 1

(First Process) Desired images were outputted to a laser printer (Model "6677" made by Fujitsu Ltd.) so as to be printed with toner on a substrate. As the substrate, there was used a paper master (Trade Name "PINK MASTER." made by Iwasaki Electric Co. Ltd.), which is on the market at present. Thereafter, the substrate was put into an oven and heated at 150° C. for 30 seconds, consequently to extinguish voids in the images formed with the toner.

(Second Process) A mixture of 98 weight % of a mixture of solventless straight-chain methylvinyl polysiloxane and methyl hydrogen polysiloxane (Trade Name "KNS-320" made by The Shin-Etsu Chemical Co. Ltd.) and 2 weight % of catalyst of platinum groups (Trade Name "CATPL-56" made by The Shin-Etsu Chemical Co. Ltd.) was applied onto the substrate having the toner image by use of a roll coater, so that the thickness of the layer thus coated on the substrate becomes 7 μm after hardening the layer at last. Thereafter, the substrate thus treated was heated in an oven at 120° C.

for 20 seconds to harden the coating on the substrate, as a result of which a silicone rubber layer serving as non-printing parts was formed.

(Third Process) Parts of the silicone rubber layer on the toner image were shaven by use of a reverse roll coater to define the printing parts and non-printing parts, thus obtaining a desired waterless planographic printing plate. Silicone rubber swarf produced as the result of shaving was removed by using a gum roller.

Upon mounting the waterless planographic printing plate thus obtained on an offset printing machine (made by Shinohara Engineering Co. Ltd.), printing of 1000 copies was made with offset ink (made by T&K Toka) for a waterless planographic printing plate. As a result, clearly printed matter could be obtained with excellent reproducibility.

EXPERIMENTAL EXAMPLE 2

The second experiment (Present Example 2) was carried out in the same way as the first experiment (Present Example 1) described above except that a cast coated paper was used as the substrate, consequently to obtain a waterless planographic printing plate. Similarly, printing of 1000 copies was carried out by using the waterless planographic printing plate in the same manner as Present Example 1 described above, as a result of which clearly printed matter could be obtained with excellent reproducibility as well.

EXPERIMENTAL EXAMPLE 3

Desired images were outputted to a laser printer (Model "7391" made by NEC Corp.) to be printed with toner on the same substrate as used in the foregoing Present Example 2. Thereafter, the substrate was passed between two TEFLON-coated rollers (i.e. rollers coated with polytetrafluoroethylene) being heated at 150° C., consequently to extinguish voids in the images formed with the toner.

Next, a mixture of 97 weight % of a mixture of solventless straight-chain methylvinyl polysiloxane and methyl hydrogen polysiloxane (Trade Name "KNS-316" made by The Shin-Etsu Chemical Co. Ltd.) and 3 weight % of catalyst of platinum groups (Trade Name "CATPL-56" made by The Shin-Etsu Chemical Co. Ltd.) was applied onto the substrate having the toner image by use of a roll coater, so that the thickness of the layer thus coated on the substrate becomes 5 $\mu$m after hardening the layer at last. Thereafter, the substrate thus treated was heated in an oven at 130° C. for 60 seconds to harden the coating on the substrate, as a result of which a silicone rubber layer for forming non-printing parts was formed.

Next, parts of the silicone rubber layer on the toner image were shaven by use of gauze to define the printing parts and non-printing parts, thus obtaining, a desired waterless planographic printing plate. Silicone rubber swarf resultantly produced was removed by using a gum roller.

In the same manner as Present Example 1 described above, by use of the waterless planographic printing plate thus obtained, printing of 1000 copies was carried out, consequently obtaining clear and sharp printed matter having excellent reproducibility.

EXPERIMENTAL EXAMPLE 4

The fourth experiment (Present Example 4) was carried out in the same way as Present Example 1 described above except that a copying machine (Trade Name "Imagio DA-355" made by Ricoh Co. Ltd.) was used instead of the printer, consequently obtaining a waterless planographic printing plate. Similarly, printing of 1000 copies was carried out by using the waterless planographic printing plate in the same manner as Present Example 1 as a result of which clearly printed matter having excellent reproducibility could be obtained as well.

EXPERIMENTAL EXAMPLE 5

The fifth experiment (Present Example 5) was carried out in the same way as Present Example 1 described above except that a thermal transfer printer (made by NEC Corp.) was used instead of the printer, consequently obtaining a waterless planographic printing plate. Similarly, printing of 1000 copies was carried out by using the waterless planographic printing plate in the same manner as Present Example 1, a result of which clearly printed matter having excellent reproducibility could be obtained as well.

EXPERIMENTAL EXAMPLE 6

The substrate with the toner image which was obtained in the first process in Present Example 1 described above was coated with a mixture containing 0.1 wt. % of water solution of polyvinyl alcohol and 0.01 wt. % of nonionic surface active agent (Trade Name "SURFY-NOL" made by Nisshin Kagaku Kogyo). The subsequent treatment was performed in the same manner as Present Example 1, consequently obtaining a waterless planographic printing plate. In the process of shaving the silicone rubber layer, the silicone rubber could be easily shaven in comparison with Present Example 1.

Similarly, printing of 1000 copies was carried out by using the waterless planographic printing plate in the same manner as Present Example 1, as a result of which clearly printed matter having excellent reproducibility could be obtained as well.

COMPARATIVE EXAMPLE 1

A waterless planographic printing plate was obtained in the same manner as Present Example 1 described above, but the substrate was not subjected to heat treatment in the first process. Consequently, the silicone rubber was difficult to release from the substrate in the third process, and could not completely be removed. Then, printing was performed by using the waterless planographic printing plate, whereas images resultantly reproduced were obscure even on a first printing sheet and lacked image density. Thus, it was found that the printing plate obtained by the prior art technique is of no practical use.

COMPARATIVE EXAMPLE 2

It was again attempted to remove the silicone rubber left on the waterless planographic printing plate in Comparative Example 1 described above by use of a sponge saturated with isoparaffin-base carbon hydride (Trade Name "ISOPAR-G" made by EXXON CORPORATION). As a result, however, the outlines of the images became more obscure, and further, the images were soiled with flakes of toner, and what is worse, the ink-repellency of the silicone rubber was deteriorated. In the same manner as Comparative Example 1, printing was performed by using the waterless planographic printing plate, but images resultantly reproduced were obscure even on a first printing sheet and lacks image density. Similarly, the printing plate obtained by this Comparative Example became of no practical use.

As is apparent from the foregoing description, according to the present invention, there can be produced a waterless planographic printing plate capable of performing clear and sharp printing of patterns, lines and so forth with excellent reproducibility without using damping water, and being suitably used for an on-demand printing system.

In addition, according to this invention, there can be provided a method for easily producing a waterless planographic printing plate for an on-demand, printing system without using a light exposing device and developing device. Besides, the method according to this invention has no need of using organic solvent, thus preventing working effectiveness in printing from being deteriorated.

Moreover, the waterless planographic printing plate produced by the method of this invention is made of a substrate of paper, and therefore, can be produced at a lower cost in comparison with the printing plate produced by the conventional method employing an aluminum printing plate as a substrate. Furthermore, the printing plate according to this invention is suitable for an on-demand printing system capable of producing the desired number of multi-color printed matter.

Although the invention has been described in its preferred form with a certain degree of particularity, it is understood that the present disclosure of the preferred form can be changed in the details of construction and the combination and arrangement of parts may be modified without departing from the spirit and the scope of the invention as hereinafter claimed.

What is claimed is:

1. A method for producing a waterless planographic printing plate, which comprises outputting desired images to be printed onto a substrate with toner, heating said substrate, forming a silicone rubber layer on said substrate having said desired images formed with toner, and shaving parts of said silicone rubber layer formed on said desired images, wherein after heating said substrate having the desired images formed with toner, water-soluble polymer is applied to the substrate and dried.

2. A method for producing a waterless planographic printing plate according to claim 1, wherein said substrate is made of paper.

* * * * *